United States Patent [19]

Moriya et al.

[11] Patent Number: 4,597,853

[45] Date of Patent: Jul. 1, 1986

[54] PITCH AS A RAW MATERIAL FOR MAKING CARBON FIBERS AND PROCESS FOR PRODUCING THE SAME

[75] Inventors: Kunihiko Moriya, Tokyo; Kazuhito Tate, Kanagawa; Goro Muroga, Tokyo; Kazuhiro Yanagida, Kanagawa, all of Japan

[73] Assignee: Mitsubishi Oil Co., Ltd., Tokyo, Japan

[21] Appl. No.: 468,910

[22] Filed: Feb. 23, 1983

[30] Foreign Application Priority Data

Feb. 23, 1982 [JP] Japan ..... 57-26740
Nov. 4, 1982 [JP] Japan ..... 57-192384

[51] Int. Cl.[4] ..... C10C 3/00; C10C 3/02; D01F 9/12

[52] U.S. Cl. ..... 208/22; 208/39; 208/44; 423/447.2

[58] Field of Search ..... 208/22, 39, 44; 423/447.2, 447.4, 447.6, 449

[56] References Cited

U.S. PATENT DOCUMENTS

| | | | |
|---|---|---|---|
| 3,147,205 | 9/1964 | Ohsol et al. | 208/45 |
| 3,373,101 | 3/1968 | Folkins et al. | 208/44 |
| 3,692,663 | 9/1972 | Ueda et al. | 208/44 |
| 3,835,024 | 9/1974 | Ueda et al. | 208/44 |
| 4,005,183 | 1/1977 | Singer | 423/447.4 |
| 4,016,247 | 4/1977 | Otani | 423/447.4 |
| 4,026,788 | 5/1977 | McHenry | 208/39 |
| 4,032,430 | 6/1977 | Lewis | 423/447.1 |
| 4,115,527 | 9/1978 | Otani et al. | 423/447.6 |
| 4,243,512 | 1/1981 | Seo | 208/39 |
| 4,271,006 | 6/1981 | Dickakian | 208/8 R |
| 4,277,324 | 7/1981 | Greenwood | 208/45 |
| 4,363,715 | 12/1982 | Dickakian | 208/40 |
| 4,427,530 | 1/1984 | Dickakian | 208/22 |
| 4,431,512 | 2/1984 | Dickakian | 208/22 |
| 4,448,670 | 3/1984 | Dickakian | 208/44 |

OTHER PUBLICATIONS

Carbon, vol. 16, No. 3, pp. 205–209, "The Influence of the Type of Quinoline Insolubles on the Quality of Coal Tar Binder Pitch", D. Ball.

*Primary Examiner*—Andrew H. Metz
*Assistant Examiner*—Helane Myers
*Attorney, Agent, or Firm*—Sughrue, Mion, Zinn, Macpeak & Seas

[57] ABSTRACT

A pitch is disclosed which is used as a raw material for making carbon fibers. The pitch has a quinoline insoluble content of 7–18% by weight and a toluene insoluble content of 70–90% by weight. Further, the pitch preferably has a n-heptane soluble content of 1.0% by weight or less. A process for producing the pitch is also disclosed. The process comprises carrying out thermal modification of a petroleum heavy residual oil having a boiling point of 400° C. or more (atmospheric pressure) and a sulfur content of 1.5% by weight or less. Insoluble substances are then separated and removed by heating at a temperature of 380° C. or less. Thereafter, a low boiling point fraction is removed by vacuum distillation. The pitch can be utilized to producd carbon fibers without breaking of filaments in spinning or adhesion by fusion of the fibers in infusibilization. The carbon fibers produced have a high tensile strength and high modulus of elasticity.

17 Claims, No Drawings

PITCH AS A RAW MATERIAL FOR MAKING CARBON FIBERS AND PROCESS FOR PRODUCING THE SAME

FIELD OF THE INVENTION

The present invention relates to a pitch used as a raw material for making carbon fibers produced from petroleum heavy residual oil and a process for producing the pitch. Particularly, the present invention relates to a process for producing the pitch suitable for producing carbon fibers which is characterized by having good processability.

BACKGROUND OF THE INVENTION

At present, production of carbon fibers having excellent strength and excellent modulus of elasticity using pitches as a raw material is roughly classified into two processes, namely, (1) a process which comprises stretching carbon fibers composed of isotropic carbon under tension at a high temperature of 2,500° C. or more and (2) a process which comprises using an anisotropic pitch as a raw material.

A typical example of the process (2) is that which comprises producing carbon fibers using a pitch containing a large amount of mesophase as a raw material. U.S. Pat. No. 4,115,527 has desclosed a process for producing carbon fibers which comprises using polynuclear aromatic compounds having a high plane structure formed by condensation of 7 or more rings as raw materials. When these raw materials are formed in fibers, orientation in the filament axis of plane molecules is observed by polarizing microspcopic observation of X-ray observation of an abrasion face parallel to the direction of filament axis. Further, in materials subjected to carbonization or graphitization, it is said that the same orientation is observed by X-ray observation after they are subjected to infusibility treatment.

A process for producing a pitch containing a large amount of mesophase is disclosed in U.S. Pat. No. 4,026,788. The disclosed process comprises carrying out thermal modification of a precursor material (substance which becomes a raw material for producing pitches) while blowing an inert gas to form a mesophase.

Further, U.S. Pat. No. 4,026,788 has disclosed a process for producing carbon fibers having high modulus of elasticity and high strength from a mesophase pitch having a mesophase content of 40 to 90% by weight. The mesophase in this case is defined as a state which can be optically observed by an examination by means of a polarizing microscope and it substantially insoluble in organic solvents such as quinoline and pyridine, etc.

So far as these patents desclose, realization of carbon fibers having high strength and high modulus of elasticity has been done using pitches containing a large amount of mesophase. It has been confirmed that carbon fibers having high strength and high modulus of elasticity can be produced if a pitch containing a large amount of mesophase is spun and infusiblization, carbonization and graphitization are carried out under a suitable condition. However, it is very difficult to carry out melt spinning of pitches containing a large amount of mesophase (components to be insoluble in quinoline and pyridine), particularly pitches containing 40% by weight or more of mesophase. Accordingly, in order to stably and industrially produce carbon fibers having high strength and high modulus of elasticity using pitches containing a large amount of mesophase as a raw material, it is necessary to overcome spinning difficulties.

On the one hand, Japanese Patent Application (OPI) 160427/79 (The term "OPI" herein refers to a "published unexamined Japanese Patent Application".) corresponding to U.S. Pat. Appln. Ser. No. 813,931 filed on July 8, 1977 has disclosed a process that when a fraction separated from an isotropic carbonaceous pitch by a solvent extraction process is heated at 230° to 400° C. for 10 minutes or less, the fraction forms a pitch having more than 75% of optical anisotrophic phase. Although pitch fibers per se and production of carbon fibers as well as the process for producing pitches is described in the above Japanese Patent Application (OPI) 160427/79, the fact that carbon fibers having high strength and high modulus of elasticity can be obtained from pitches according to the process of the present invention is not described therein.

Further, Japanese Patent Application (OPI) 88016/82 has disclosed a process for producing a mesophase containing pitch which comprises carrying out thermal modification of a precursor material and then concentrating mesophase by a gravity settling method. Further, Japanese Patent Application (OPI) 57881/81 (corresponding to U.S. Pat. Appln. Ser. No. 79,891 filed on Sept. 28, 1979) has disclosed a process which obtained a component containing a large amount of mesophase from a pitch as a precursor material by an extracting operation using a solvent. However, in this case, it is also required that the caronaceous precursor material of the pitch is a precursor material capable of forming a pitch having a large portion of mesophase by a thermal process as described in U.S. Pat. No. 4,005,183.

In any case, these processes comprise an operation of thermal modification in the pitch production process. Generally, there are few cases where a chemically pure compound is used as a precursor material, and petroleum or coal heavy oils are used as the precursor material in many cases. These petroleum or coal heavy oils contain some impurities though the amounts are very small. When they are subjected to thermal modification, dehydrogenation reactions proceed to form substances which are near carbon and difficult to fuse even if heated. Accordingly, it has been generally required to treat at a temperature as low as possible and lengthen the thermal modification time as long as possible as described in the above described U.S. Pat. Nos. 4,026,788 and 4,032,430. However, formation of small amounts of substances which are difficult to fuse is an inevitable problem.

When producing carbon fibers using a pitch containing such substances which are difficult to fuse, troubles such as breaking of filaments or blockade of spinning nozzles are caused when the pitch is spun. Of course, it is possible to remove such impurities from the raw material of pitch by means of filtration or others before spinning. However, when the amount thereof is large, filtration becomes difficult due to high viscosity of the raw material of pitch and, at the same time, it is necessary to frequently carry out cleaning of the filter. Consequently, much time is required which deteriorates economization, making the process undesirable industrially.

On the other hand, before carbonization of a pitch, infusibilization is generally carried out in order to prevent deformation caused by fusion of the pitch. Particularly, in case of carbon fibers, infusibilization is often carried out by oxidizing pitch fibers spun in an oxidative atmosphere such as air, etc. In this case, if infusibilization is insufficiently carried out, adhesion by fusion of fibers themselves is caused or shrinkage of fibers is caused. If such fibers having insufficient infusibility are carbonized, carbon fibers having excellent strength and excellent modulus of elasticity cannot be obtained.

As described above, the mesophase is defined hitherto as a state in which optical anisotropy can be optically observed by a polarizing microscopic examination and it is substantially insoluble in organic solvents such as quinoline or pyridine. In Japanese Patent Applications (OPI) 57881/81 and 88016/82, the mesophase is defined as a state in which optical anisotropy can be optically observed by polarizing microscopic examination. However, it is impossible to recognize qualitative features of the mesophase by only the fact that optical anisotropy is shown in the polarizing microscopic examination. Further, it is quantitatively difficult to discriminate a main component composing the mesophase and the other components, when they are coexistent. Particularly, in pitches produced from mixtures such as petroleum heavy oils as precursor material, it is right to think that various substances are coexistent.

As a result of various studies relating to pitches suitable as raw materials for carbon fibers, we have found that, in pitches which not only produce carbon fibers having high strength and high moddulus of elasticity as a final product but also have excellent processability and, particularly excellent spinnability, and are difficult to cause adhesion by fusion in case of carrying out infusiblization, amounts of n-heptane insoluble component, quinoline insoluble component and toluene insoluble component are in a quite limited range, and a pitch having such properties can be produced economically.

SUMMARY OF THE INVENTION

The first object of the present invention is to provide a pitch used as a raw material for carbon fibers having high strength and high modulus of elasticity and a process for producing such a pitch.

The second object of the present invention is to provide process for economically producing a pitch having excellent processability, particularly excellent spinnability, which is difficult to cause adhesion by fusion when carrying out infusibilization.

These objects of the present invention are attained by providing a pitch (used as a raw material for carbon fibers) having 7 to 18% by weight of a quinoline insoluble component and 70 to 90% by weight of a toluene insoluble component which is produced by a process comprising carrying out thermal modification of a petroleum heavy residual oil having a boiling point of 400° C. or more (atmospheric pressure) and a sulfur content of 1.5% by weight or less, separating and removing insoluble substances while heating at a temperature of 380° C. or less, and then removing a low boiling point fraction by vacuum distillation.

Namely, a petroleum heavy residual oil having a boiling point of 400° C. or more and a sulfur content of 1.5% by weight is subjected to thermal modification at a temperature of 380° to 450° C. for a heating time of 1 to 30 hours under such a condition that the yield of the thermally modified oil is 80% by weight or more without applying pressure, and thereafter insoluble substances are separated and removed from the thermally modified oil at a temperature of 380° C. or less, preferably 200° to 350° C. by a separation means utilizing gravity or centrifugal force or filtration, etc., with heating at the above described temperature.

Then, the product from which insoluble substances are removed is subjected to vacuum distillation under a pressure of 1.0 Torr or less at a liquid temperature in the system of 370° to 390° C. to remove low boiling point substances having a boiling point of 400° C. or less (atmospheric pressure), preferably 750° C. or less, whereby a pitch is obtained by a series of operations. The resulting pitch has a n-heptane soluble content of 1.0% by weight or less, a quinoline insoluble content of 7 to 18% by weight and a toluene insoluble content of 70 to 90% by weight.

DETAILED DESCRIPTION OF THE INVENTION

Examples of petroleum heavy residual oils used as raw materials for producing the pitch of the present invention include oils derived from atmospheric pressure distillation residual oils of petroleum crude oil, hydrodesulfurization residual oils, hydrocracking residual oils, thermal cracking residual oil, catalytic craking residual oils and solvent extraction residual oils (extract) formed as a by-product in case of producing lubricant oils, etc. are used. However, they must have a boiling point of 400° C. or more, preferably 410° C. or more, under atmospheric pressure. If the boiling point of the oil is less than 400° C., required heating becomes difficult under atmospheric pressure, and the resulting pitch has inferior properties. Further, the precursor raw materials must have a sulfur content of 1.5% weight or less. Sulfur components contained in the pitch are substances which are not suitable for producing carbon fibers having high strength and high modulus of elasticity. Since removal of sulfur components after production of the pitch is very difficult and not industrially economical, it is effective and economical to restrict the sulfur content of the precursor raw material to 1.5% by weight or less so as to reduce the sulfur content in the produced pitch to a certain limit or less. The sulfur content is measured by a method prescribed in JIS K-2541 (JIS refers to Japanese Industrial Standard). The thermal modification is carried out at a temperature of 380° to 450° C., preferably 410° to 450° C., for a heating time of 1 to 30 hours, preferably 1 to 20 times, without applying pressure. In the thermal modification, blowing of gas or reduction of pressure are not carried out. The top of the thermal modification container is cooled so as to prevent removal of a light fraction formed during the thermal modification, as far as the thermal modification temperature is kept at a prescribed temperature, and the thermal modification is carried out so that the yield of the thermally modified oil remaining in the heating apparatus becomes 80% by weight or more, preferably 90% by weight or more. In this case, it is not preferred to carry out the thermal modification under a high pressure condition in order to increase the yield, because thermal modification reaction is suppressed under a high pressure condition. In such thermal modification, when the mterial thermally modified is observed by a reflection polarizing microscope after abrading the material, an optically anisotropic phase is not substantially revealed.

If the light fraction is removed from the system, separation of insoluble substances carried out thereafter becomes difficult. If the optically anisotropic phase in thermally modified oil appears, components required for the pitch are removed and spinnability deteriorates.

Then, insoluble substances which deteriorates spinnability are separated and removed from the thermally modified material (thermally modified oil) by a separation process utilizing gravity or centrifugal force or by means of filtration, etc. with heating at a temperature of 380° C. or less, preferably 350° C. or less and, more preferably 200° to 350° C. In this case, the heating temperature is 380° C. or less because optically anisotropic substances are not formed by heating. On the other hand, if it is less than 200° C., separation and removal of insoluble substances become difficult, because viscosity of the thermally modified oil is high. Of course, separation and removal of insoluble substances is not absolutely impossible at a temperature lower than the above described temperature range, but it is not preferred industrially. In any case, removal of insoluble substances in this stage can be very easily carried out, because the viscosity of the thermally modified oil is by far lower than the viscosity of finally resulting pitch. Separation and removal of insoluble substances result in removal of substances which do not fuse in case of spinning, by which breaking of filament is remarkably reduced and spinning can be stably carried out. Then, the material from which insoluble substances are removed is subjected to vacuum distillation to remove a low boiling point fraction having a boiling point of 400° C. or less (atmospheric pressure), preferably 750° C. or less.

When using a batch vacuum distillation apparatus, vacuum distillation is carried out under conditions that a pressure is 1.0 Torr or less, preferably 0.5 Torr or less, and a liquid temperature of the bottom in the system is 370° to 390° C. When using a continuous vacuum distillation apparatus, the vacuum distillation is carried out under conditions that a pressure is 1.0 Torr or less, preferably 0.5 Torr or less, and a liquid temperature of the flash zone and the bottom of the distillation tower is 370° to 390° C. These pressure and the liquid temperature are restricted within a very limited range, and it is difficult to obtain a pitch having good properties if they depart from the above described ranges. Namely, when the presure is more than 1.0 Torr and the liquid temperature is less than 370° C., it becomes difficult to keep the n-heptane soluble component at the value of 1.0% or less by weight and the toluene insoluble component becomes less than 70% by weight which is out the range of the present invention. Further, when the liquid temperature is more than 390° C., the amount of the quinoline insoluble component increases to exceed 18% by weight of the present invention and, at the same time, insoluble substances are formed in this step.

By selecting the condition of each step from the above described very narrow ranges considering properties of the precursor material, a pitch having a quinoline insoluble content of 7 to 18% by weight and a toluene insoluble content of 70 to 90% by weight, preferably 75 to 90% by weight, more preferably 80 to 90% by weight is produced and, preferably a pitch having a n-heptane soluble content of 1.0% by weight or less. When the resulting pitch has a quinoline insoluble content of less than 7% by weight and a toluene insoluble content of less than 70% by weight, carbon fibers having high modulus of elasticity can not be produced, thought spinnability is good. On the other hand, if the quinoline insoluble content is more than 18% by weight, spinnability deteriorates and stabilized spinning becomes difficult to carry out because breaking of filaments is freuently caused when spinning.

When the n-heptane soluble content is more than 1.0% by weight, infusibilization is not well carried out. The component soluble in n-heptane is principally composed of saturated hydrocarbons having a low molecular weight. Since this component is chemically stable as compared with other components, it is poor in oxidation reactivity at a low temperature such as for infusibilization. Accordingly, the pitch containing a large amount of such component easily causes adhesion by fusion when carrying out infusibilization. Accordingly, it is preferred to remove the component soluble in n-heptane, as much as possible. In the present invention, it has been found that the amount of n-heptane soluble component is preferred to be 1.0% by weight or less.

Further, concerning amounts of the quinoline insoluble component and the toluene insoluble component, there is the following fact. Hitherto, in case of carbon fibers, particularly those having high strength and high modulus of elasticity, the pitch as a raw material is often prescribed by the amount of the optically anisotropic component by means of a polarizing microscope. However, the quality of the optically anisotropic component as well as the amount thereof is important. Namely, in case of a material having a highly developed optically anisotropic structure, there is no problem in the case of a material such as coke in which the shape is not so much important, but there is a problem of difficulty in spinning in the case of a material such as carbon fibers in which fine processing, for example, making fibers from pitches, is required. On the one hand, a latent anisotropic pitch (which does not substantially form a mesophase in a fused state and forms a wholly homogeneous optically isotropic single phase, and which shows orientation in the direction of applying an external force) is disclosed in Japanese Patent Application (OPI) 100186/82. Therefore, it is clear that it is difficult to determine properties of the pitch by only the amount of the optically anisotropic component observed by a polarizing microscope.

As a result of producing various kinds of pitch and studying spinnability, adhesion by fusion and relations to properties of the resulting carbon fibers, it has been found that properties of good pitches can be prescribed qualitatively by amounts of the n-heptane soluble component, the quinoline insoluble component and the toluene insoluble component as described above. The pitch having a n-heptane soluble content of 1.0% by weight or less, a quinoline insoluble content of 7 to 18% by weight and a toluene insoluble content of 70 to 90% by weight cannot be simply obtained by conventional processes, and its production can be realized by carrying out each step of the present invention under ther restricted condition. The pitch having each component in the above described restricted range has excellent spinnability and it is difficult to cause adhesion by fusion, by which it becomes possible to produce carbon fibers having high strength and high modulus of elasticity.

Here, measurement of n-heptane soluble content is carried out by a method which comprises putting 5 g of powdered pitch in a cylindric filter having an average opening size of 1$\mu$, thermally extracting with n-heptane for 20 hours utilizing a Soxhlet extractor, and weighing the resulting soluble component after removing the solvent. The quinoline insoluble content and the toluene insoluble content are measured by methods prescribed in JIS K-2425 (JIS refers to Japanese Industrial Standard). According to the present invention, a pitch having excellent spinability and good infusibility can be prescribed, and at the same time, it becomes possible to produce a pitch capable of forming carbon fibers having high strength and high modulus of elasticity, wherein insoluble substances are removed from an intermediate product having a comparatively low viscosity and, thereafter, infusibilization can be easily carried out so as not to form insoluble substances which cause breaking of filaments when spinning.

Production of carbon fibers can be carried out by spinning, insolubilizing, carbonizing and graphitizing by conventional processes as described in U.S. Pat. No. 3,767,741.

In the following, the present invention is illustrated in greater detail by examples. However, the present invention is not limited to these examples.

EXAMPLE 1

After a solvent extraction oil (boiling point: 400° C. or more, sulfur content: 0.5% by weight) obtained as by-product in the case of refining of a lubricant oil was subjected to thermal modification at 410° C. for 16 hours, it was allowed to settle down with heating at 360° C. to precipitate insoluble substances. The insoluble substances are separated and removed by decantation, and the material from which insoluble substances were removed was then subjected to vacuum distillation to remove a low boiling point fraction having a boiling point of 400° C. or less, by which a pitch was obtained. This pitch had a quinoline insoluble content of 15.4% by weight and a toluene insoluble content of 73.2% by weight. When this pitch was subjected to melt spinning at a spinning temperature of 364° C. by means of a spinning nozzle having a nozzle opening diameter of 0.5 mm $\phi$, pitch fibers having a diameter of 20$\mu$ did not cause any breaking of filaments for 10 minutes. After these pitch fibers were infusiblized at 260° C. in the air atmosphere, they were carbonized at 2,000° C. in an inert gas atmosphere. The resulting fibers had a tensile strength of 15.6 Ton/cm$^2$ and a modulus of elasticity of 2,400 Ton/cm$^2$.

EXAMPLE 2

A residual oil obtained as by-product in a catalytic cracking process was distilled to remove a fraction having a boiling point of 400° C. or less, by which a heavy residual oil having a boiling point of 400° C. or more was obtained. The sulfur content of this heavy residual oil was 1.27% by weight. After this heavy residual oil having a boiling point of 400° C. or more was subjected to thermal modification at 410° C. for 20 hours, it was allowed to settle down with heating at 360° C. to precipitate insoluble substances. After the insoluble substances were removed by decantation, the material from which insoluble substances were removed was subjected to vacuum distillation to remove a low boiling point fraction having a boiling point of 400° C. or less, by which a pitch was obtained. This pitch had a quinoline insouble content of 16.5% by weight and a toluene insoluble content of 77.4% by weight. When this pitch was subjected to melt spinning at a spinning temperature of 365° C. by means of a spinning nozzle having a nozzle opening size of 0.5 mm $\phi$, pitch fibers having a diameter of 20$\mu$ did not cause any breaking of filaments for 10 minutes. After these pitch fibers were infusiblized at 260° C. in the air atmosphere, they were carbonized at 2,000° C. in an inert gas atmosphere. The resulting fibers and a tensile strength of 16.9 Ton/cm$^2$ nd a modulus of elasticity of 4,100 Ton/cm$^2$.

COMPARATIVE EXAMPLE 1

After the same catalytic cracking heavy residual oil having a boiling point of 400° C. or more as that used in Example 2 was subjected to thermal modification at 410° C. for 20 hours with blowing a $N_2$ gas, a low boiling point fraction having a boiling point of 400° C. or less was separated and removed by vacuum distillation to obtain a pitch. This pitch had a quinoline insoluble content of 29.7% by weight and a toluene insoluble content of 62.4% by weight. When this pitch was subjected to melt spinning at a spinning temperature of 365° C. by means of a spinning nozzle having a nozzle opening size of 0.5 mm $\phi$, pitch fibers having a diameter of 20$\mu$ caused breaking of filaments on the average 8 times per 10 minutes. After these pitch fibes were infusiblized at 260° C. in the air atmosphere, they were carbonized at 2,000° C. in an inert gas atmosphere. The resulting fibers had a tensile strength of 7.8 Ton/cm$^2$ and a modulus of elasticity of 2,100 Ton/cm$^2$.

COMPARATIVE EXAMPLE 2

After the same catalytic cracking heavy residual oil having a boiling point of 400° C. or more as that used in Example 2 was subjected to thermal modification at 410° C. for 5 hours with blowing a $N_2$ gas, a low boiling point fraction having a boiling point of 400° C. or less was separated and removed by vacuum distillation to obtain a pitch. This pitch had a quinoline insoluble content of 5.6% by weight and a toluene insoluble content of 45.7% by weight. When this pitch was subjected to melt spinning at a apinning temperature of 363° C. by means of a spinning nozzle having a nozzle opening size of 0.5 mm $\phi$, pitch fibhers having a diameter of 10$\mu$ did not cause any breaking of filaments for 10 minutes. After these pitch fibers were infusiblized at 260° C. in the air atmosphere, they were carbonized at 2,000° C. in an inert gas atmosphere. The resulting fibers had a tensile strength of 6.6 Tom/cm$^2$ and a modulus of elasticity of 410 Ton/cm$^2$.

COMPARATIVE EXAMPLE 3

A residual oil obtained as by-product in the catalytic cracking process was distilled to obtain a heavy residual oil having a boiling point of 400° C. or more. The sulfur content of this heavy residual oil was 2.7% by weight. After this heavy residual oil was subjected to thermal modification at 410° C. for 20 hours, it was allowed to settle down with heating at 360° C. to precipitate insoluble substances. After the insoluble substances were separated and removed by decantation, the material from which insoluble substances were removed was subjected to vacuum distillation to separate and remove a low boiling point fraction having a boiling point of 400° C. or less, by which a pitch was obtained. This pitch had a quinoline insoluble content of 22.5% by weight and a toluene insoluble content of 68.7% by weight. When this pitch was subjected to melt spinning at a spinning temperature of 365° C. by means of a spinning nozzle having a nozzle opening size of 0.5 mm $\phi$, pitch fibers having a diameter of 20$\mu$ caused breaking of filaments on the average 6 times per 10 minutes. After these pitch fibers were infusiblized at 260° C. in the air atmosphere, they were carbonized at 2,000 ° C. in an inert gas atmosphere. The resulting fibers had a tensile strength of 11.0 Ton/cm$^2$ and a modulus of elasticity of 1,790 Ton/cm$^2$.

EXAMPLE 3

A residual oil obtained as by-product in the catalytic cracking process was subjected to vacuum distillation to remove a fraction having a boiling point of 415° C. or less, by which a heavy residual oil having a boiling point of 415° C. or more was obtained. The sulfur content of this heavy oil was 1.25% by weight. When this heavy residual oil having a boiling point of 415° C. or more was subjected to thermal modification at 420° C. for 10 hours, the yield of the thermally modified oil was 85.5% by weight. This thermally modified oil was allowed to settle down with heating at 340° C. and insoluble substances were separated by precipitation and removed. Thereafter, the material from which insoluble substances were removed was subjected to vacuum distillation by a batch vacuum distillation apparatus at a liquid temperature of the bottom part of 385° C. under a pressure of 0.2 Torr to remove a low boiling point fraction having a boiling point of 720° C. or less, by which a pitch was obtained. This pitch had a n-heptane soluble content of 0.5% by weight, a quinoline insoluble content of 15.6% by weight and a toluene insoluble content of 88.5% by weight.

When this pitch wa subjected to melt spinning at a spinning temperature of 365° C. by means of a spinning nozzle having a nozzle opening size of 0.5 mm $\phi$, it was possible to carry out spinning of fibers having a diameter of 20$\mu$ at a winding rate of 500 m/min without causing any breaking of filaments for 10 minutes.

After these pitch fibers were infusiblized at 300° C. in the air atmosphere, they were carbonized at a mzximum arrival temperature of 2,500° C. in the inert gas atmosphere. The resulting fibers had a tensile strength of 21.0 Ton/cm$^2$ and a modulus of elasticity of 6,100 Ton/cm$^2$.

EXAMPLE 4

When a solvent extraction oil having a boiling point of 430° C. or more and a sulfur content of 0.5% by weight which was obtained as by-products in case of refining of lubricant oil was subjected to thermal modification at 430° C. for 4 hours, the yield of the thermally modified oil was 88.9%. This thermally modified oil was allowed to settle down with heating at 300° C. and insoluble substances were separated by precipitation and removed. Thereafter, the material from which insoluble substances were removed was subjected to vacuum distillation by a batch vacuum distillation apparatus at a liquid temperature of the bottom part of 383° C. under a presure of 0.3 Torr to remove a low boiling point fraction having a boiling point of 702° C. or less, by which a pitch was obtained. This pitch had a n-heptane soluble content of 0.5% by weight, a quinoline insoluble content of 16.7% by weight and a toluene insoluble content of 87.8% by weight. When this pitch was subjected to melt spinning at a spinning temperature of 370° C. by means of a spinning nozzle having a nozzle opening size of 0.5 mm $\phi$, it was possible to carry out spinning of fibers having a diameter of 20$\mu$ at a winding rate of 500 m/min without causing any breaking of filaments for 10 minutes. After these pitch fibers were infusiblized at 300° C. in the air atmosphere, they were carbonized at a maximum arrival temperature of 2,500° C. in an inert gas atmosphere. The resulting fibers had a tensile strength of 18.4 Ton/cm$^2$ and a modulus of elasticity of 5,900 Ton/cm$^2$.

COMPARATIVE EXAMPLE 4

When the same catalytic cracking heavy residual oil (boiling point: 415° C. or more) as that used in Example 3 was subjected to thermal modification at 410° C. for 20 hours with blowing a $N_2$ gas, the yield of the thermally modified oil was 76.7% by weight. This thermally modified oil was subjected to vacuum distillation by a batch vacuum distillation apparatus at a liquid temperature of the bottom part of 410° C. under a pressure of 10 Torr. The resulting pitch had a n-heptane soluble content of 3.5% by weight, a quinoline insoluble content of 29.7% by weight and a toluene insoluble content of 62.4% by weight. When this pitch was subjected to melt spinning at a spinning temperature of 365° C. by means of a spinning nozzle having a nozzle opening size of 0.5 mm $\phi$, fibers having a diameter of 20$\mu$ caused breaking of filaments on the average 8 times per 10 minutes at a winding rate of 500 m/min. After the pitch fibers were infusiblized at 300° C. in the air atmosphere, they were carbonized at a maximum arrival temperature of 2,500° C. in an inert gas atmosphere. The resulting fibers had a tensile strength of 7.0 Ton/cm$^2$ and a modulus of elasticity of 100 Ton/cm$^2$.

COMPARATIVE EXAMPLE 5

When the same catalytic cracking heavy residual oil (boiling point: 415° C. or more) as that used in Example 3 was subjected to thermal modification at 410° C. for 8 hours, the yield of the thermally modified oil wa 89.1% by weight. This thermally modified oil was subjected to vacuum distillation by a batch vacuum distillation apparatus at a liquid temperature of the bottom part of 400° C. under a pressure of 10 Torr. The resulting pitch had a n-heptane soluble content of 4.7% by weight, a quinoline insoluble content of 5.9% by weight and a toluene insoluble content of 49.6% by weight.

When this pitch was subjected to melt spinning at a spinning temperature of 362° C. by means of a spinning nozzle having a nozzle opening size of 0.5 mm $\phi$, fibers having a diameter of 20$\mu$ caused breaking of filaments on the average 2 times per 10 minutes at a winding rate of 500 m/min. After these pitch fibers were infusiblized at 300° C. in an air atmosphere, they were carbonized at a maximum arrival temperature of 2,500° C. in an inert gas atmosphere. The resulting fibers had a tensile strength of 5.4 Ton/cm$^2$ and a modulus of elasticity of 500 Ton/cm$^2$.

From the results shown in the above examples and comparative examples, it can be seen that the pitch produced in accordance with the process of the present invention provides various advantages that the troubles such a breaking of filaments in the spinning stage and adhesion by fusion of fibers themselves in the infusibilization are remarkably prevented, and the pitch is useful for the production of carbon fibers having excellent strength and modulus of elasticity.

While the present invention has been described in detail and with reference to specific embodiments thereof, it will be apparent to one skilled in the art that various changes and modifications can be made therein without departing from the spirit and scope thereof.

What is claimed is:

1. A process for producing a pitch used as a raw material for carbon fibers, the pitch having a quinoline insoluble content of 7 to 18% by weight and a toluene insoluble content of 70 to 90% by weight and a n-heptane soluble content of 1.0% by weight or less, which comprises carrying out thermal modification of a petroleum heavy residual oil having a boiling point of 400° C. or more (atmospheric pressure) and a sulfur content of 1.5% by weight or less by heating the same at a temperature of 380° to 450° C. for 1 to 30 hours under atmospheric pressure so as to obtain a thermally modified oil in a yield of the thermally modified oil of 80% by weight or more, separating and removing insoluble substances undissolved in the thermally modified oil at a temperature of 200° to 380° C. from the thermally modified oil by the action of gravity or centrifugal force with heating at a temperature of from 200° to 380° C., and removing a low boiling point fraction having a boiling point of 400° C. or less by vacuum distillation at a pressure of 1.0 Torr or less.

2. A process for producing a pitch according to claim 1, wherein the vacuum distillation is carried out under a condition comprising a pressure of 1.0 Torr or less and a liquid temperature in the system of 370° to 390° C.

3. A process for producing a pitch according to claim 1, wherein the petroleum heavy residual oil has a boiling point of 410° C. or more.

4. A process for producing a pitch according to claim 1, wherein insoluble substances were separated and removed from the thermally modified oil with heating it to a temperature of 350° C. or less.

5. A process for producing a pitch according to claim 1, wherein the petroleum heavy oil is subjected to thermal modification at a temperature of 410° to 450° C. for a time of 1 to 20 hours without applying pressure under such a condition that the yield of the thermally modified oil is 80% by weight or more.

6. A process for producing a pitch according to claim 1, wherein the insoluble substances are separated and removed from the thermally modified oil at a temperature of 200° to 350° C. by utilizing gravity or centrifugal force.

7. A process for producing a pitch according to claim 1, wherein the material from which insoluble substances are removed is subjected to vacuum distillation by a batch vacuum distillation apparatus under a pressure of 1.0 Torr or less at a liquid temperature of the bottom in the system of 370° to 390° C. to remove a low boiling point fraction having a boiling point of 750° C. or less (atmospheric pressure).

8. A process for producing a pitch according to claim 1, wherein the material from which insoluble substances are removed is subjected to vacuum distillation by a continuous vacuum distillation apparatus under a pressure of 1.0 Torr or less at a liquid temperature of the flash zone in the system or the bottom in the distillation tower of 370° to 390° C. to remove a low boiling point fraction having a boiling point of 750° C. or less (atmospheric pressure).

9. A process for producing a pitch according to claim 1, wherein the material from which insoluble substances are removed is subjected to vacuum distillation by a batch distillation apparatus under a pressure of 0.5 Torr or less at a liquid temperature of the bottom in the system of 370° to 390° C. to remove a low boiling point fraction having a boiling point of 750° C. or less (atmospheric pressure).

10. A process for producing a pitch according to claim 1, wherein the material from which insoluble substances are removed is subjected to vacuum distillation by a continuous vacuum distillation apparatus under a pressure of 0,5 Torr or less at a liquid temperature of the flash zone in the system or the bottom in the distillation tower of 370° to 390° C. to remove a low boiling point fraction having a boiling point of 750° C. or less (atmospheric pressure).

11. A process for producing a pitch according to claim 1, wherein the pitch has a quinoline insoluble content of 7 to 18% by weight, a toluene insoluble content of 75 to 90% by weight and a n-heptane soluble content of 1.0% by weight or less.

12. A process for producing a pitch according to claim 11, wherein the pitch has a toluene insoluble content of 8 to 90% by weight.

13. A process for producing a pitch according to claim 1, when the thermally modified oil is obtained at a yield of 90% by weight or more, separating and removing insoluble substances is conducted at 200° to 350° C., vacuum distillation is conducted at a pressure of 1.0 Torr or less at a liquid temperature of 370° to 390° C. and thermal modification is conducted without the application of pressure.

14. A process for producing a pitch according to claim 1, wherein the thermally modified product is substantially free of an optically anisotropic phase.

15. A process for producing a pitch according to claim 1, wherein the thermal modification is carried out by cooling the top of the apparatus used so that a light-fraction formed during the thermal modification is not removed, whereby the separating and removing of insoluble substances is improved as compared to the case the light fraction is removed.

16. A process for producing a pitch according to claim 1, wherein said soluble substances do not fuse in spinning.

17. A process for producing a pitch according to claim 1, wherein said n-heptane soluble content comprises principally saturated hydrocarbons of low molecular weight which promote adhesion by fusion in infusibilization.

* * * * *